US005720825A

United States Patent [19]

Kinnaird

[11] Patent Number: 5,720,825

[45] Date of Patent: Feb. 24, 1998

[54] METHOD OF CLEANING TAR AND ASPHALT OFF OF PAVING OR OTHER EQUIPMENT USING COMBINATIONS OF ESTERS AND TERPENES

[75] Inventor: Michael Gates Kinnaird, Durham, N.C.

[73] Assignee: Chemtek, Incorporated, Durham, N.C.

[21] Appl. No.: 593,012

[22] Filed: Jan. 29, 1996

[51] Int. Cl.[6] ..... B08B 7/00; B08B 9/20

[52] U.S. Cl. ..... 134/40; 134/4; 134/25.1; 134/34; 134/38

[58] Field of Search ..... 134/25, 1, 34, 134/38, 40, 4

[56] References Cited

U.S. PATENT DOCUMENTS

| | | | |
|---|---|---|---|
| 4,704,225 | 11/1987 | Stoufer | 134/40 X |
| 4,867,800 | 9/1989 | Dishart et al. | 134/40 X |
| 5,120,371 | 6/1992 | Bolden et al. | 134/40 |
| 5,143,639 | 9/1992 | Krawack | 134/40 X |
| 5,194,173 | 3/1993 | Folkard et al. | 134/40 |
| 5,230,821 | 7/1993 | Larson | 252/170 |
| 5,264,045 | 11/1993 | Zofchak | 134/40 |
| 5,338,368 | 8/1994 | Fletcher | 134/40 |
| 5,340,493 | 8/1994 | Principato | 134/40 |
| 5,407,490 | 4/1995 | Zofchak | 134/40 |
| 5,421,907 | 6/1995 | Nieendick et al. | 134/40 |
| 5,494,611 | 2/1996 | Howe | 134/40 X |
| 5,549,839 | 8/1996 | Chandler | 134/40 X |

FOREIGN PATENT DOCUMENTS

| | | |
|---|---|---|
| 3913911 | 11/1990 | Germany . |
| 2033421 | 5/1980 | United Kingdom . |
| 9222678 | 12/1992 | WIPO . |

*Primary Examiner*—Arlen Soderquist

[57] ABSTRACT

This invention relates to a method for cleaning bituminous asphalt- and tar-coated equipment, using combinations of alkyl esters with terpene cosolvents and/or surfactants. The specific invention is the use of ester solvents in combination with terpene solvents, optionally with emulsifiers and other additives. The combination of the two is found surprisingly to exhibit the excellent solvency of terpene solvents, but with the slower evaporating rate and higher flashpoint properties of ester solvents.

11 Claims, No Drawings

METHOD OF CLEANING TAR AND ASPHALT OFF OF PAVING OR OTHER EQUIPMENT USING COMBINATIONS OF ESTERS AND TERPENES

BACKGROUND OF THE INVENTION

1. Field of the Invention

This invention pertains to a method of cleaning paving equipment or other equipment soiled with tar, asphalt, pitch, tack, cutback, or other asphalt-related material. The method uses combinations of alkyl esters and terpene hydrocarbons.

2. Prior Art

Traditionally, paving contractors and others handling asphalt have had a problem with buildup of asphalt and asphalt-related liquids such as tar, pitch and tack on equipment used to deliver, handle or otherwise manipulate them. After a certain amount of buildup occurs, the equipment is no longer able to be used for its intended purposes, and cleaning becomes necessary. Traditionally, diesel fuel or some similar fuel has served this purpose as an inexpensive cleaning solvent. However, due to the environmental persistence of petroleum hydrocarbons, the use of these solvents has become outlawed, by such laws as the Federal Water Pollution Control Act Amendments of 1972 (PL 92-500) Section 311(b)(1), as well as other Federal and state laws.

Therefore, contractors and others have desired other solvents to use for this purpose. One such solvent is d-limonene. This material comes from citrus fruit, and is therefore biodegradable. It has good solvency properties, and works well for this application. Other terpene hydrocarbons have also been used. There are however, two significant problems associated with the use of these terpene hydrocarbons. One is their relatively low flashpoint, typically 106°–120° F. (closed cup). This presents some hazards during use, especially on hot days or with hot paving equipment in the vicinity of running motors. Likewise, thin films of the terpene solvents evaporate readily when used outside in the summertime, leading to evaporative loss of cleaning capacity.

Another biodegradable solvent with good solvency properties but with a higher flashpoint would therefore be desirable.

U.S. Pat. No. 5,230,821 Larson, et al Cleaning Composition

This patent is specifically about an oil-in-water emulsion used to clean cars and trucks and/or parts thereof in automobile refinishing shops (col 1, line 5). The main advantages over prior art are the lowered VOC content of the mixture, since it is mostly water (col 1, lines 10–40), and the fact that since water is present in the cleaning composition, water-soluble soils are also removed (col 1, line 35). Tar is specifically mentioned in various places, and some of the compositions were used to remove tar from automotive panels (e.g. Col 6, lines 58–67).

However, the cleaning capacity of any aqueous emulsion is necessarily greatly less than that of a comparable cleaner with no aqueous phase present. Also, when in use, addition of additional oil-phase component tends to break the emulsion, rendering it useless for further cleaning. This means that while cleaning paving or other tar-soiled equipment the emulsion would break. Likewise, the stability of emulsions in cold weather is typically poor, greatly limiting outside storage stability on job sites.

Furthermore, the organic phases in the combinations in this patent are primarily composed of petroleum or other hydrocarbons, which are well known to be efficacious in removing tar and asphalt. What is needed is a combination that involves materials other than hydrocarbons, especially other than petroleum hydrocarbons, and yet still retains their cleaning potential.

SUMMARY OF THE INVENTION

It has been discovered that certain esters of fatty acids have good solvency properties for asphalt and tar and related products, with the added advantages of higher flashpoint, slower evaporation rate, and improved biodegradability when combined with terpenes. The combination exhibits the excellent solvency of the terpenes, but with a higher flashpoint and slower evaporation rate.

The cleaning compositions used in this invention comprise:

1) An alkyl ester, 2) a terpene cosolvent, and 3) optional surfactants for improving rinseability The ratio of alkyl ester to terpene cosolvent is 55% ester/45% terpene to 95% ester/5% terpene. The emulsifiers typically comprise 0% to 30% of the mixture.

In a preferred embodiment, the alkyl ester is a methyl ester of a mixture of naturally-derived fatty acids, and the terpene cosolvent is a mixture of natural origin. In another aspect of the present invention, the above described cleaning composition is employed to clean the surface of equipment or vehicles that are soiled with tar or asphalt or related materials.

DETAILED DESCRIPTION OF THE INVENTION

This invention is directed to a method of cleaning asphalt and related materials off of paving equipment, with a cleaning composition that has a flashpoint and biodegradability higher than, and an evaporation rate lower than those typical of terpene solvents alone, but has excellent cleaning capacity for tar, asphalt and related materials. Further, the composition is biodegradable, and relatively non-toxic.

The present method can be used for a variety of applications, including but not limited to cleaning asphalt-carrying trucks, pavers, shovels, rakes, etc. It has the added advantage that it can be used to prevent asphalt from sticking to surfaces cleaned with it or precoated with it.

The solvents used in this invention are typically comprised of an ester, an optional terpene cosolvent, and an optional emulsifier or emulsifier blend. The ratio of the ester portion to the terpene portion of the mixture is from 55% ester/45% terpene to 95% ester/5% terpene.

The ester may be a mixture of esters of varying hydrocarbon chain lengths and degrees of unsaturation. The alcohols used to make the esters include but are not limited to methyl, ethyl, propyl, iso-propyl, butyl, isobutyl, tert-butyl, pentyl, hexyl, octyl, 2-ethylhexyl, and longer-chain fatty alcohols. Phenyl, benzyl and other aromatic alcohols may also conceivably be used. Combinations and mixtures could also be used to advantage. In a preferred embodiment, the alcohol group is methyl or isopropyl. In the most preferred embodiment, the alcohol group is methyl.

The synthetic or naturally-derived fatty acids include but are not limited to: acetic, propionic, butyric, pentanoic, hexanoic, 2-ethylhexanoic, heptanoic, octanoic, nonanoic, captic, lauric, myristic, palmitic, margaric, stearic, acachidic, behenic, lignoceric, myristoleic, palmitoleic, oleic, linoleic, linolenic, licosenoic behenic and erucic phthalic, isophthalic, terephthalic, maleic, fumaric, oxalic, malonic, succinic, glutaric, adipic, pimelic, suberic, azelaic, sebacic acids and isomers and mixtures of these The preferred embodiment acids are fatty acid mixtures primarily in the C-8–C18 range, and are naturally-derived.

Examples of typical terpene solvents used optionally with ester solvents include d-limonene and various pine-derived or citrus-derived dipentenes. This list is not exhaustive, other terpene solvents are useful as well.

Typically, emulsifiers are added to cleaning solvents to aid in rinseability, but are not necessary. The useful range of the emulsifier portion of the mixture is typically from 0 to around 30%. Typical emulsifiers could be nonylphenol ethoxylates, octylphenol ethoxylates, dinonylphenol ethoxylates, fatty alcohol ethoxylates, alkyl polyglycosides, amides, salts of fatty acids, phosphate esters of nonylphenol ethoxylates or octylphenol ethoxylates or dinonylphenol ethoxylates or fatty alcohol ethoxylates and salts thereof, amphoteric surfactants such as cocoamphodiproprionates, cationic surfactants such as alkyltrimethyl ammonium chlorides, fatty acid alkanolamides such as coconut oil fatty acid diethanolamides, etc. Mixtures of these and other emulsifiers may also be used, and are part of this invention as well.

Likewise other cosolvents may be added as well, for other purposes. The use of ternary (or higher) solvent blends involving ester solvents is part of this invention as well.

EXAMPLES.

Example 1

The procedure used in this example is as follows. A sheet of aluminum foil is weighed, and coated in the center with a sprayable bituminous asphaltic chain/gear lubricant, and then dried in the oven at 80°–100° C. for 5 minutes, then re-weighed. A solvent is then applied in an amount equal to the gear lubricant, and the sheet tilted in various directions to expose all of the asphalt to solvent repeatedly, for two minutes. The sheet is then placed upright and allowed to drain for 30 minutes, and then rinsed thoroughly with water. The sheet is then dried in the oven at 80°–100° C. until a constant weight is obtained. The weight of the removed material is calculated, and ratioed with the initial weight to obtain a percent of removal. A list of materials and percent removal is given below in Table 1.

TABLE 1

Percent Asphaltic Bitumen Removal for Several Solvents

| SOLVENT | % REMOVAL |
|---|---|
| technical d-limonene | 80 |
| technical d-limonene with 3% emulsifiers | 88 |
| odorless mineral spirits | 60 |
| methyl laurate 90% | 86 |
| methyl coconate | 83 |
| pine-based dipentene | 43 |

As can be seen, the methyl ester solvents give comparable bitumen removal to technical d-limonene with relatively long exposure times, and superior to that of the pine-based terpene tested.

Example 2

The procedure of example 1 was repeated for mixtures of methyl esters and a pine-based terpene, with 3% of a proprietary emulsifier added in. The contact time with the solvent was one minute, and the liquid was allowed to drain for one minute prior to rinsing and oven drying. As can be seen from the table, the mixture of the pine-based terpene with the methyl ester was similar to the pine-based terpene alone in ability to penetrate quickly, even though the methyl ester was in the majority.

TABLE 2

Percent Asphaltic Bitumen Removal for Several Solvent Mixtures

| SOLVENT MIXTURE | % REMOVAL |
|---|---|
| 97% methyl coconate 3% emulsifier | 33 |
| 97% pine-based terpene, 3% emulsifier | 53 |
| 64.5% methyl coconate, 32.5% pine-based terpene, 3% emulsifier | 46 |

Example 3

A 40/60 mixture of d-limonene and 90% methyl laurate was tested for closed-cup flashpoint. The flashpoint was determined to be 141° F., compared to a typical flashpoint for d-limonene of 115°–119° F.

Example 4

A mixture of methyl coconate 200 parts, a pine-based terpene solvent 120 parts, and emulsifier A from example 3 10 parts and a fragrance 2.5 parts were used to remove tack from a tank truck and asphalt from a dump truck, and compared with diesel fuel. By visual inspection, it was obvious that the ester/pine-based terpene solvent mixture was far superior in removing tack and asphalt, both in rapidity of attack, and in amount removed per amount sprayed on. The difference in rapidity of attack was quite marked.

Example 5

Samples of a typical pine-based terpene and a methyl coconate ester solvent were spread out in a thin film on the benchtop in a laboratory at 22° C. After about 5 minutes, the terpene solvent spot was nearly completely gone, whereas several days later, the methyl coconate ester spot was still there, for all intents and purposes unchanged. This illustrates the greatly slower tendency of the preferred embodiment ester solvents to evaporate.

While the preferred embodiments of this invention have been described above, and an attempt has been made to describe them in detail, it must be understood that variations and modifications can be made therein without departing from the spirit and scope of the present invention as set forth in the claims below.

For instance, other cosolvents may be added as well, for other purposes. The use of ternary (or higher) solvent blends involving ester solvents does not depart from the spirit and scope of this invention.

I claim:

1. A method of cleaning bituminous asphalt and related materials off of paving equipment consisting essentially of, contacting the equipment with a non-aqueous cleaning solvent for an effective amount of time and optionally rinsing the cleaning solvent off with water, wherein said cleaning solvent consists essentially of an ester or mixture of ester, a terpene and an optional emulsifier, wherein a ratio of ester to terpene in the cleaning solvent varies from 55% ester/45% terpene to 95% ester/5% terpene, and wherein the emulsifier has a concentration of 0% to 30% of the cleaning solvent.

2. The method of claim 1, wherein the alcohol portion of the ester has from 1 to 18 carbon atoms.

3. The method of claim 1, wherein the acid portion of the ester is selected from the group consisting of acetic, propionic, butyric, pentanoic, hexanoic, 2-ethylhexanoic, heptanoic, octanoic, nonanoic, captic, lauric, myristic, palmitic, margaric, stearic, acachidic; behenic, lignoceric, myristoleic, palmitoleic, oleic, linoleic, linolenic, licosenic, erucic, phthalic, isophthalic, terphthalic, maleic, fumaric, oxalic, malonic, succinic, glutaric, adipic, pimelic, suberic, azelaic, sebacic, and mixtures thereof.

4. The method of claim 1, wherein the terpene is selected from the group consisting of d-limonene, pine-derived dipentenes, and citrus-derive dipentenes.

5. The method of claim 1, wherein the emulsifier is selected from the group consisting of nonylphenol ethoxylates, octylphenol ethoxylates, dinonylphenol ethoxylates, fatty alcohol ethoxylates, alkyl glycosides, amides, fatty acid salts, amphoteric surfactants, cationic surfactant, alkanolamides or fatty acids, phosphate esters and salts thereof of nonylphenol ethoxylates, octylphenol ethoxylates, and fatty alcohol ethoxylates, and mixtures thereof.

6. The method of claim 1, wherein the alcohol portion of the ester is methanol.

7. The method of claim 1, wherein the alcohol portion of the ester isopropanol.

8. The method of claim 1, wherein the acid portion of the ester is derived from coconut oil.

9. The method of claim 1, wherein the acid portion of the ester is derived from tall oil.

10. The method of claim 1, wherein the acid portion of the ester has 11 or more carbon atoms.

11. The method of claim 1, wherein the acid portion of the ratio of ester to terpene in the cleaning solvent varies from 60% ester/40%. terpene to 95% ester/5% terpene.

* * * * *